US008939119B2

(12) United States Patent
Werner et al.

(10) Patent No.: US 8,939,119 B2
(45) Date of Patent: Jan. 27, 2015

(54) CAMSHAFT ADJUSTMENT DEVICE

(75) Inventors: Matthias Werner, Dunningen-Seedorf (DE); Thomas Golz, Sipplingen (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 14/122,389

(22) PCT Filed: Apr. 18, 2012

(86) PCT No.: PCT/EP2012/057039
§ 371 (c)(1),
(2), (4) Date: Nov. 26, 2013

(87) PCT Pub. No.: WO2012/163591
PCT Pub. Date: Dec. 6, 2012

(65) Prior Publication Data

US 2014/0190430 A1 Jul. 10, 2014

(30) Foreign Application Priority Data

May 30, 2011 (DE) ..... 10 2011 050 730

(51) Int. Cl.
*F01L 1/14* (2006.01)
*F01L 1/344* (2006.01)
*F01L 13/00* (2006.01)

(52) U.S. Cl.
CPC ..... *F01L 1/344* (2013.01); *F01L 13/0036* (2013.01); *F01L 2013/0052* (2013.01)
USPC ..... 123/90.48; 123/90.11; 123/90.44; 123/90.6

(58) Field of Classification Search
USPC ..... 123/90.11, 90.44, 90.48, 90.6
See application file for complete search history.

(56) References Cited

U.S. PATENT DOCUMENTS 7,472,671 B2 * 1/2009 Elendt et al. ..... 123/90.6
8,176,887 B2 5/2012 Golz et al.

(Continued)

FOREIGN PATENT DOCUMENTS

DE 102006051809 A1 5/2008

(Continued)

*Primary Examiner* — Ching Chang
(74) *Attorney, Agent, or Firm* — Bachman & LaPointe, PC

(57) ABSTRACT

A camshaft adjuster (3), comprising a camshaft axis of rotation (D) and an electromagnetic multi-tappet actuating device (4) having at least two electromagnetic drive units, which for exerting an actuating force on a corresponding number of elongated tappet units (9, 10, 11) which are mounted axially parallel to one another, each defining a tappet longitudinal center axis (A1, A2, A3) arranged perpendicularly to the camshaft axis of rotation (D) are activatable, in order to engage with the tappet units (9, 10, 11) in shifting grooves (8) of an adjustable cam piece (7), wherein the drive units each on a facing acting end on one of the associated tappet units (9, 10, 11) form an acting surface that is moveable in an actuating direction of the drive units and an end face on the acting side facing away from the respective associated shifting groove (8) of a respective one of the tappet units (9, 10, 11) interacts with the acting surface, wherein at least one of the tappet units (9, 10, 11) is arranged relative to the camshaft axis of rotation (D) in such a manner that its tappet longitudinal center axis (A1, A2, A3) running parallel to the tappet longitudinal center axes (A1, A2, A3) of the at least one other tappet unit (9, 10, 11) is spaced from the camshaft axis of rotation (D) in a plane (E) receiving the camshaft axis of rotation (D) and running perpendicularly to the tappet longitudinal center axes (A1, A2, A3).

20 Claims, 2 Drawing Sheets

(56) References Cited

U.S. PATENT DOCUMENTS

| | | | |
|---|---|---|---|
| 8,493,166 | B2 | 7/2013 | Golz et al. |
| 2010/0192885 | A1 | 8/2010 | Golz et al. |
| 2011/0267159 | A1 | 11/2011 | Schiepp et al. |

FOREIGN PATENT DOCUMENTS

| | | | |
|---|---|---|---|
| DE | 102007028600 | A1 | 12/2008 |
| DE | 102007040677 | A1 | 3/2009 |
| DE | 102007057811 | A1 | 6/2009 |
| DE | 202009015468 | A1 | 2/2010 |
| DE | 202008015980 | A1 | 4/2010 |
| DE | 102009015486 | A1 | 9/2010 |
| DE | 102009030375 | A1 | 12/2010 |
| WO | 2010012498 | A1 | 2/2010 |

* cited by examiner

CAMSHAFT ADJUSTMENT DEVICE

BACKGROUND OF THE INVENTION

The present invention relates to a camshaft adjuster according to the preamble of Patent Claim 1, comprising a camshaft axis of rotation defined by a camshaft, in particular by a carrier shaft of a camshaft, about which the camshaft is rotatable.

Because of the limited installation space in the region of a displacement engine of a motor vehicle there is frequently the need of realising the electromagnetic multi-tappet actuating device, comprising a plurality of activatable (typically selectively, i.e. independently of one another) tappet units in a sufficiently compact manner, so that on the one hand a sufficient electromagnetic functionality is ensured (for example with respect to the necessary adjusting stroke of the tappet units as well as reaction or switching times) and on the other hand there is no undesirable mutual influencing—mechanically or electromagnetically.

From DE 10 2007 040 677 A1 a camshaft adjuster is known, in which the tappet units interacting with a drive unit each are arranged in such a manner that their respective tappet longitudinal centre axis intersects the axis of rotation of the camshaft. At the same time, the drive units are arranged offset in circumferential direction of the camshaft, so that the tappet longitudinal centre axes of the tappet units run angularly to one another. This results in a comparatively large installation space that is required. Disadvantageous are also production-related difficulties.

From DE 10 2007 028 600 A1, an electromagnetic multi-tappet actuating device for a camshaft adjuster that is optimised with respect to the installation space requirement is known, wherein the installation space minimisation is the result of the drive units being arranged in such a manner that the tappet units that are actuatable by these or the tappet longitudinal centre axes defined by the tappet units are arranged parallel in a row one after the other, wherein all tappet longitudinal centre axes intersect the camshaft axis of rotation also in this case. The known electromagnetic actuating device for camshaft adjusters has proved itself. In particular, the axially parallel arrangement of the tappet units with respect to one another constitutes an economic as well as system-related robust advantage in contrast with the tappet units which are arranged offset over the circumference of the camshaft, in which the tappet longitudinal centre axis intersects the camshaft axis of rotation, wherein however the overlap region between tappet unit and actuator is rather small. Efforts are made to configure the electromagnetic actuating device of the camshaft adjuster even more compact and more efficient with respect to the installation space, wherein however as large as possible a contact area between the tappet units and the associated drive units is to be ensured.

SUMMARY OF THE INVENTION

The object of the present invention therefore is to create a camshaft adjuster, comprising an electromagnetic multi-tappet actuating device according to the preamble of the main claim, which is even further optimised with respect to installation space, wherein it is to be ensured at the same time that as large as possible an overlap region (contact area) between the face ends of the tappet units on the acting side (driving side) and the acting surface of the respective associated drive unit is provided.

This object is solved through the camshaft adjuster having the features disclosed herein. Advantageous further developments of the invention are also stated herein. The scope of the invention includes all combinations of at least two features disclosed in the description, the claims and/or the figures.

In a camshaft adjuster, comprising an electromagnetic multi-tappet actuating device, the invention is based on the idea of arranging the tappet units which are axially parallel to one another in such a manner that the tappet longitudinal centre axis of at least one of the tappet units, moving away from the teaching of the prior art, preferentially does not intersect an axis of rotation of the camshaft defined by a carrier shaft but is spaced in an imaginary plane in which the aforementioned axis of rotation lies and perpendicularly to which all tappet longitudinal centre axes run, in particular by a dimension of more than 0.3 mm, preferentially by more than 0.5 mm. Thus, the invention consciously accepts the supposed disadvantage of a force loading which is off centre with respect to the axis of rotation of the cam piece which is to be preferentially adjusted axially with respect to the aforementioned axis of rotation in order to thereby advantageously achieve an installation space-optimised arrangement of the drive units with associated tappet units, wherein the arrangement of the tappet units according to the invention advantageously ensures that an overlap as large an area as possible is provided between tappet units and drive units. While the present invention is most preferred in the context of a multi-tappet actuating device providing for more than one drive unit and a corresponding number of tappet units, the invention also encompasses a structure of just one electromagnetic drive unit having one associated tappet unit.

Preferably, each drive unit is formed by an in particular permanent magnet armature. Preferably, each armature is assigned a separate coil (energisable winding), wherein an embodiment can also be realised in which for example according to the principle described in DE 20 2008 015 980 U1, a plurality of armatures with a common coil are driven.

As will still be explained later on, it is realisable depending on installation situation to space only a single tappet longitudinal centre axis in the described plane from the axis of rotation and to position the at least one further tappet longitudinal centre axis so that the latter intersects the axis of rotation. It is also possible to arrange the tappet units (guided longitudinally displaceably) in such a manner that none of the tappet longitudinal centre axes intersects the axis of rotation. It is likewise realisable that a plurality of tappet longitudinal centre axes are spaced in the aforementioned plane, preferentially by the same dimension from the axis of rotation of the camshaft, in particular of a carrier shaft of the camshaft and at least one, preferentially exclusively one tappet longitudinal centre axis intersects the axis of rotation.

It has proved to be particularly advantageous in the case of the spacing of a plurality of tappet longitudinal centre axes from the axis of rotation of the camshaft, to space these from the axis of rotation in the aforementioned plane by the same dimension each. It is particularly practical in the case of the spacing of at least two tappet longitudinal centre axes to space these in the axis of rotation in directions opposing one another, i.e. to arrange these in such a manner that at least one tappet longitudinal centre axis is spaced from the axis of rotation in the aforementioned plant opposite to the direction of rotation of the camshaft and at least one further one in the direction of rotation. It is even further preferred in the case of the arrangement of an even number of tappet longitudinal centre axes spaced from the axis of rotation of the camshaft if these are evenly spaced from the axis of rotation of the camshaft over the two different directions (against the direction of rotation and in the direction of rotation).

Driving the elongated (even preferably cylindrical, further preferably realised from a metal material) tappet units is effected in the manner known per se, for example in the manner described in DE 10 2007 028 600 A1 in that the tappet units sit (preferably adhere there by means of magnetic action) on an acting surface of a respective associated drive unit, wherein the acting surface typically forms the distal end of an armature unit of the drive unit concerned.

It has proved to be particularly advantageous if the at least one tappet longitudinal centre axis spaced from the axis of rotation of the camshaft in the aforementioned plane is spaced from the axis of rotation by a dimension of at least 0.5 mm. Most preferably, the spacing amounts to between 0.5 mm and 8.0 mm, preferentially between 1.0 mm and 5.0 mm, even further preferably between 1.0 mm and 2.0 mm, and most preferably the spacing amounts to approximately 1.5 mm. Here it is particularly preferred in the case of providing a total of three tappet units, to space a with respect to the longitudinal extension of the axis of rotation middle tappet unit or its tappet longitudinal centre axis from the axis of rotation of the shaft, namely preferably by a dimension selected from the aforementioned value ranges, wherein even further preferred the two further (outer) tappet longitudinal centre axes intersect the axis of rotation within the scope of the usual tolerances of less than 0.2 mm.

It is particularly preferred to space the at least one tappet longitudinal centre axis, preferentially all tappet longitudinal centre axes spaced from the axis of rotation of the camshaft in the plane from the camshaft axis of rotation by a dimension, in particular by the same dimension which is calculated based on half the base circle diameter of the associated shifting groove. Half the base circle diameter in this case is to mean half the diameter of an imaginary circle along which the groove base of the shifting groove extends. Particularly preferably, the spacing measured in the aforementioned plane amounts to between 3% and approximately 80%, preferentially between approximately 3% and approximately 50%, even further preferably between approximately 3% and approximately 30%, even further preferably between approximately 3% and approximately 20% of this half base circle diameter of the preferentially spirally running shifting groove assigned to the respective tappet unit. Generally it is preferred when the spacing amounts to less than 15% of this half base circle diameter and/or more than 5%.

Very particularly preferred is an embodiment of the camshaft adjuster, in which the multi-tappet actuating device altogether comprises at least three, preferentially exclusively three drive units each with an associated tappet unit, wherein the at least three tappet units, in particular the exclusive three tappet units can be arranged as will be explained in the following.

According to a first preferred embodiment it is possible to arrange merely a single one of the plurality of tappet longitudinal centre axes in a manner intersecting the camshaft axis of rotation, wherein the further tappet longitudinal centre axes, preferentially the two further tappet longitudinal centre axes in the previously explained plane are preferentially spaced from the camshaft of the axis of rotation by the same dimension. It is particularly practical in the case of the providing of a total of three tappet units to arrange the with respect to the longitudinal extension of the axis of rotation middle tappet unit in a manner intersecting the axis of rotation.

According to a second preferred embodiment version, at least two, preferentially exclusively two of the at least three, in particular of the exclusively three tappet longitudinal centre axes intersect the camshaft axis of rotation. Preferably, this concerns two tappet longitudinal centre axes which in the direction of the longitudinal extension of the axis of rotation of the camshaft are next to one another, i.e. adjacent.

According to a third version, all of the at least three, preferentially of the exclusively three tappet longitudinal centre axes are spaced from the camshaft axis of rotation in the aforementioned plane, in particular by the same dimension each.

It has proved to be particularly advantageous when the tappet longitudinal centre axes which are arranged in the direction of the longitudinal extension of the camshaft axis of rotation one after the other are equally spaced in this axial direction. Expressed differently, each tappet longitudinal centre axis defines a tappet plane, which receives the respective tappet longitudinal centre axis, wherein the respective tappet planes arranged in the direction of the longitudinal extension of the axis of rotation arranged next to one another are spaced by the same dimension relative to one another.

The arrangement of the tappet units becomes particularly compact in that at least one of the tappet units with its end face on the acting side sits eccentrically and/or with merely a part area of the end face on the acting side on the associated acting surface.

Within the scope of a preferred embodiment it has proved to be favourable that the drive units are assigned a common housing, which particularly preferably interacts on the face end with a housing guide portion which typically offers guides—typically in the form of through-openings running parallel to one another, in particular through-bores—for the plurality of tappet units, wherein these must then be arranged relative to one another and with respect to the camshaft axis of rotation so that at least one tappet longitudinal centre axis does not intersect the aforementioned axis of rotation. The result created by the present invention in a surprisingly simple and elegant manner is an arrangement which combines a compact design with assembly-friendliness, high operational safety and optimal switching and magnetic characteristics while ensuring generous overlap regions between the tappet units and the drive units at the same time.

BRIEF DESCRIPTION OF THE DRAWINGS

Further advantages, features and details of the invention are obtained from the following description of exemplary embodiments and with the help of the drawings. These show in.

DETAILED DESCRIPTION

Figure 2:
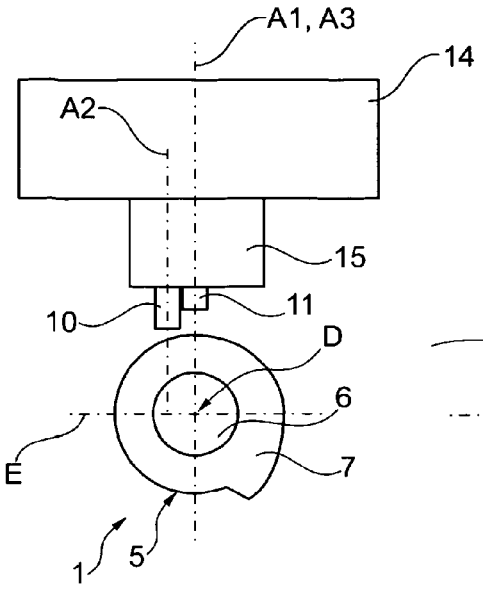

The figures of the same element and elements having the same functions are marked with the same reference characters.

Figure 1:
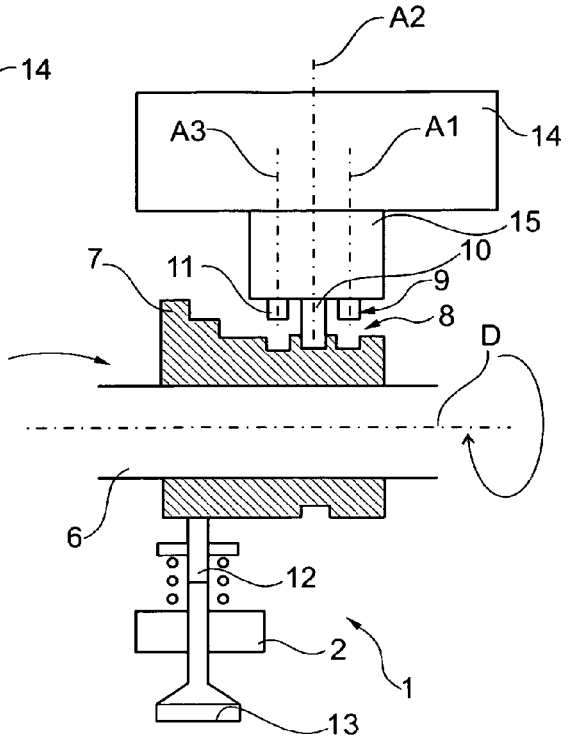
FIG. 1 a highly schematic overall representation of a camshaft adjuster for an internal combustion engine with variable gas exchange valve drive in a partially sectioned longitudinal view, FIG. 2 a camshaft adjuster in a transverse view, FIG. 3 a view of an actuating device of a camshaft adjuster in a view from below with altogether three tappet units, wherein a tappet longitudinal centre axis of a middle tappet unit is spaced from an axis of rotation of the camshaft, FIG. 4 an alternative exemplary embodiment of an actuating device for a camshaft adjuster, in which two or three tappet longitudinal centre axes are spaced from the camshaft axis of rotation on different sides, and FIG. 5 a further alternative exemplary embodiment of a multi-tappet actuating device of a camshaft adjuster, in which the tappet longitudinal centre axis of an outer tappet unit is arranged laterally offset with respect to the axis of rotation of the camshaft and the other two tappet longitudinal centre axes intersect the camshaft axis of rotation.

FIGS. 1 and 2 show exemplary embodiments of variable gas exchange valve drives for an internal combustion engine 2 indicated in FIG. 1. FIGS. 1 and 2 in this case show possible configurations of the camshaft adjusters 3 with an electromagnetic multi-tappet actuating device 4. The camshaft adjusters 3 according to FIGS. 1 and 2 each comprise a camshaft 5, comprising a carrier shaft 6 on which a cam piece 7 with a plurality of cam elevations of different geometry is arranged in a rotationally fixed and axially displaceable manner. The carrier shaft 6 is rotatorically driveable about a camshaft axis of rotation D by means of the internal combustion engine 2. In the cam piece 7, spirally formed shifting grooves 8 are introduced adjacently to the cam elevations, wherein the shifting grooves 8 are assigned a plurality of, in the shown exemplary embodiment, three tappet units 9, 10, 11. Depending on configuration of the camshaft adjuster 3, a shifting groove 8 can be assigned a single tappet unit or a plurality of the tappet units. The tappet units 9, 10, 11 can be coupled into the shifting grooves 8 with the help of drive units of the adjusting drive 4 which are not separately shown in order to thereby axially adjust the cam piece relative to the carrier shaft 6. As a function of the axial position of the cam piece 7 on the carrier shaft 6, different cam elevations of the cam piece 7 with a cam follower 12 act on a gas exchange valve 13 which is spring force loaded in closing direction in a manner known per se.

Each of the cylindrical, elongated tappet units 9, 10, 11 defines a tappet longitudinal centre axis A1, A2, A3, wherein the tappet longitudinal centre axes A1, A2, A3 are arranged parallel to one another and perpendicularly to the camshaft axis of rotation D.

The tappet units 9, 10, 11 each act together with a drive unit each with a face end (on the acting side or actuator side) which is not shown and facing away from the cam piece 7 in a manner which is extensively described in DE 10 2007 028 600 A1, more precisely with a planar acting surface of the respective drive unit. Regarding the arrangement and the interaction of the tappet units on the drive units, reference is made to the disclosure content of DE 10 2007 028 600 A1 of the applicant, wherein the disclosure content of that publication is to be considered included in the present disclosure as belonging to the present invention, and incorporated herein by reference.

The drive units which are not separately shown are received in a common, cylindrical housing 14, which on the face end interacts with a housing guide portion 15, in which the tappet units 9, 10, 11 are guided in a longitudinally displaceable manner.

As is evident from FIG. 2, the tappet longitudinal centre axis A2 of a middle (second tappet unit 10) is arranged laterally spaced or offset with respect to the camshaft axis of rotation D (axis of rotation) in a plane E, thus does not intersect the latter. The aforementioned plane E receives the camshaft axis of rotation D and runs perpendicularly to all tappet longitudinal centre axes A1, A2, A3. The further two (outer) or first and second tappet units 9, 11 are arranged in such a manner that they intersect the axis of rotation D in the plane E.

Figure 3:
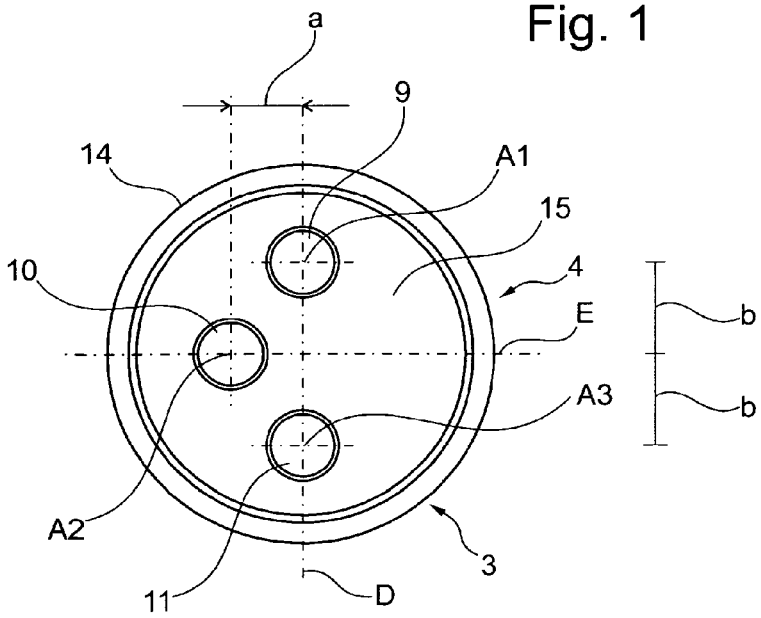

FIG. 3 shows an exemplary embodiment of an electromagnetic multi-tappet actuating device 4 of a camshaft adjuster 3 which is otherwise not shown further in FIG. 3 in a view from below. Drawn in is the camshaft axis of rotation D, which is arranged in a plane E lying perpendicularly to the tappet longitudinal centre axes A1 to A3. The tappet units 9, 10, 11 are longitudinally displaceably guided in the guide portion 15 of the housing in such a manner that the two viewed in the direction of the longitudinal extension of the camshaft axis of rotation D outer tappet longitudinal centre axes A1 and A3 intersect the camshaft axis of rotation D in the plane E, whereas the tappet longitudinal centre axis A2 of the middle tappet unit 10 is arranged laterally spaced from the camshaft axis of rotation D, namely by the dimension a, of in the shown exemplary embodiment approximately 1.5 mm. The two outer tappet longitudinal centre axes A1, A3 are equally spaced in the direction of the axial extension of the camshaft axis of rotation D from the middle tappet longitudinal centre axis A2, namely by the dimension b of in the shown exemplary embodiment approximately 7 mm. The diameter of the circle-cylindrical tappet units 9, 10, 11 in the exemplary embodiment amounts to approximately 4.5 mm. The diameter of the hollow-cylindrical housing 14 amounts to approximately 20 mm.

Figure 4:
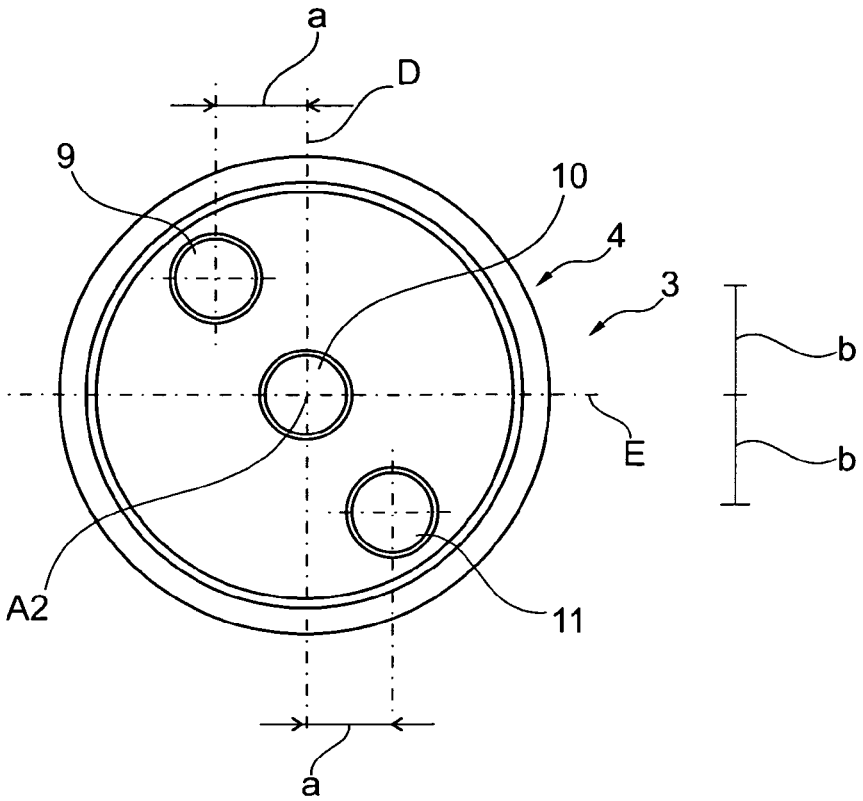

FIG. 4 shows an alternative embodiment of a multi-tappet actuating device 4 of a camshaft adjuster 3. Again noticeable is the camshaft axis of rotation D, which is arranged in the plane E, with respect to which the tappet longitudinal centre axes A1 to A3 run perpendicularly. In the shown exemplary embodiment, the tappet units 9, 10, 11 are arranged in such a manner that the viewed in the direction of the longitudinal extension of the camshaft axis of rotation D middle (second tappet unit 10 or its tappet longitudinal centre axis A2 intersects the camshaft axis of rotation D in the plane E, whereas the in the middle tappet longitudinal centre axis A2) parallel tappet longitudinal centre axes A1, A3 of the outer tappet units 9, 10 are spaced in the plane E from the camshaft axis of rotation D, namely by the same absolute dimension a, of in the shown exemplary embodiment approximately 1.5 mm. It is evident that the outer tappet longitudinal centre axes A1, A3 are arranged on different sides of the camshaft axis of rotation D. Viewed in axial direction based on the camshaft axis of rotation D, two adjacent tappet longitudinal centre axes A1, A2; A2, A3 each are evenly spaced from one another, namely by the dimension b measured in the direction of the camshaft axis of rotation D of the shown exemplary embodiment 7 mm.

Figure 5:
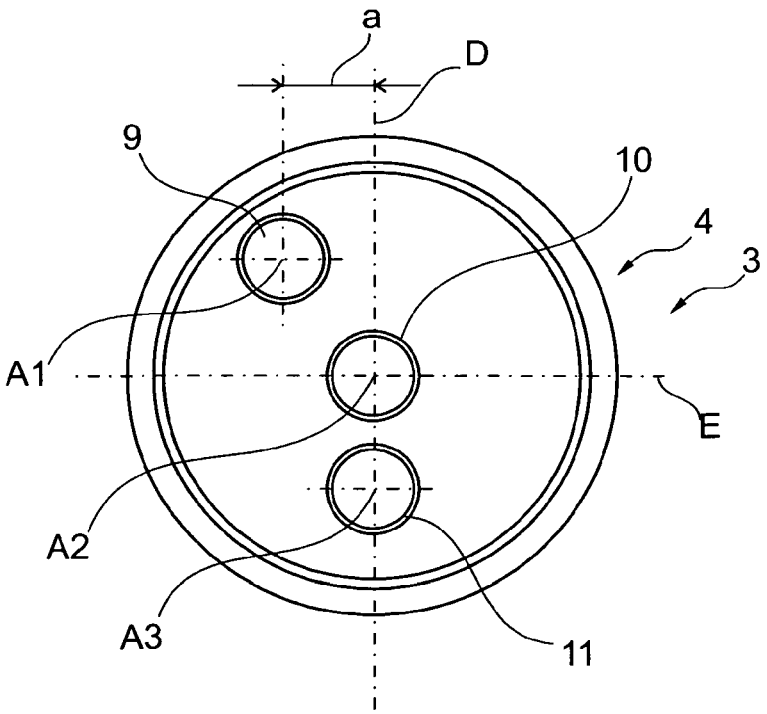

The exemplary embodiment according to FIG. 5 of a multi-tappet actuating device 4 of a camshaft adjuster 3 has in common with the exemplary embodiment according to FIG. 3 that exclusively one tappet longitudinal centre axis in the plane E is spaced from the camshaft axis of rotation D. In contrast with the exemplary embodiment according to FIG. 3, it does not however relate to the middle tappet longitudinal centre axis but to an outer tappet longitudinal centre axis A1, here of the first tappet unit 9, while the tappet longitudinal centre axes A2, A3 of the middle (second tappet unit) and of the third tappet unit 11 intersect the camshaft axis of rotation D.

The invention claimed is:

1. A camshaft adjuster (3), comprising a camshaft axis of rotation (D) and an electromagnetic multi-tappet actuating device (4) having at least two electromagnetic drive units, which for exerting an actuating force on a corresponding number of elongated tappet units (9, 10, 11) which are mounted axially parallel to one another, each defining a tappet longitudinal centre axis (A1, A2, A3) arranged perpendicularly to the camshaft axis of rotation (D) are activatable, in order to engage with the elongated tappet units (9, 10, 11) in shifting grooves (8) of an adjustable cam piece (7), wherein the drive units each on a facing acting end on one of the associated elongated tappet units (9, 10, 11) form an acting surface that is moveable in an actuating direction of the electromagnetic drive units and an end face on the acting side facing away from the respective associated shifting groove (8) of a respective one of the elongated tappet units (9, 10, 11) interacts with the acting surface, wherein at least one of the elongated tappet units (9, 10, 11) is arranged relative to the camshaft axis of rotation (D) in such a manner that its tappet longitudinal centre axis (A1, A2, A3) running parallel to the tappet longitudinal centre axes (A1, A2, A3) of the at least one other elongated tappet unit (9, 10, 11) is spaced from the camshaft axis of rotation (D) in a plane (E) receiving the camshaft axis of rotation (D) and running perpendicularly to the tappet longitudinal centre axes (A1, A2, A3).

2. The camshaft adjuster according to claim 1, wherein the at least one tappet longitudinal centre axis (A1, A2, A3) spaced from the camshaft axis of rotation (D) in the plane is spaced by a distance measured perpendicularly to the camshaft axis of rotation (D) out of a value range between 0.5 mm and 8.0 mm.

3. The camshaft adjuster according to claim 2, wherein the distance is between 1.0 mm and 5.0 mm.

4. The camshaft adjuster according to claim 2, wherein the distance is between 1.0 mm and 2.0 mm.

5. The camshaft adjuster according to claim 1, wherein the at least one tappet longitudinal centre axis (A1, A2, A3) spaced from the camshaft axis of rotation (D) is spaced from the camshaft axis of rotation (D) in the plane between 3% and 80%, of half the base circle diameter of the associated shifting groove (8).

6. The camshaft adjuster according to claim 5, wherein the at least one tappet longitudinal centre axis is spaced from the camshaft axis of rotation in the plane between 3% and 50% of half of the base circle diameter of the associated shifting groove.

7. The camshaft adjuster according to claim 5, wherein the at least one tappet longitudinal centre axis is spaced from the camshaft axis of rotation in the plane between 3% and 30% of half of the base circle diameter of the associated shifting groove.

8. The camshaft adjuster according to claim 5, wherein the at least one tappet longitudinal centre axis is spaced from the camshaft axis of rotation in the plane between 3% and 20% of half of the base circle diameter of the associated shifting groove.

9. The camshaft adjuster according to claim 1, wherein at least three drive units with associated tappet units (9, 10, 11) are provided.

10. The camshaft adjuster according to claim 9, wherein exclusively three drive units with associated tappet units are provided.

11. The camshaft adjuster according to claim 1, wherein a single one of the tappet longitudinal centre axes (A1, A2, A3) intersects the camshaft axis of rotation (D).

12. The camshaft adjuster according to claim 1, wherein at least two tappet longitudinal centre axes (A1, A2, A3) which are arranged next to one another intersect the camshaft axis of rotation (D).

13. The camshaft adjuster according to claim 12, wherein exclusively two tappet longitudinal centre axes which are arranged next to one another intersect the camshaft axis of rotation.

14. The camshaft adjuster according to claim 1, wherein all tappet longitudinal centre axes (A1, A2, A3) are spaced from the camshaft axis of rotation (D) in the plane.

15. The camshaft adjuster according to claim 1, each tappet longitudinal centre axis (A1, A2, A3) defines a tappet plane which is perpendicularly penetrated by the camshaft axis of rotation (D), and wherein the spacing measured in the direction of the longitudinal extension of the camshaft axis of rotation (D) between each two adjacent ones of the tappet planes is the same in the case of each adjacent tappet planes.

16. The camshaft adjuster according to claim 1, wherein at least one of the elongated tappet units (9, 10, 11) with its end face on the acting side sits eccentrically and/or with merely a part surface of the end face on the acting side on the associated acting surface.

17. The camshaft adjuster according to claim 1, wherein the electromagnetic drive units are arranged in a common, hollow-cylindrical housing (14).

18. The camshaft adjuster according to claim 1, wherein the elongated tappet units (9, 10, 11) are fixed on the at least one actuator unit in a magnetically adhering manner.

19. The camshaft adjuster according to claim 1, wherein the elongated tappet units (9, 10, 11) each have a hardened engagement end entering into interaction with at least one of the shifting grooves (8).

20. A camshaft adjuster (3), comprising a camshaft axis of rotation (D) and an electromagnetic tappet actuating device (4) having at least one electromagnetic drive unit, which for exerting an actuating force on a corresponding elongated tappet unit (9, 10, 11) defining a tappet longitudinal centre axis (A1, A2, A3) arranged perpendicularly to the camshaft axis of rotation (D) and activatable, in order to engage with the corresponding elongated tappet unit (9, 10, 11) in a shifting groove (8) of an adjustable cam piece (7), wherein the electromagnetic drive unit, on a facing acting end on the corresponding elongated tappet unit (9, 10, 11), forms an acting surface that is moveable in an actuating direction of the electromagnetic drive unit and an end face on the acting side facing away from the shifting groove (8) of the corresponding elongated tappet unit (9, 10, 11) interacts with the acting surface, wherein the tappet unit (9, 10, 11) is arranged relative to the camshaft axis of rotation (D) in such a manner that its tappet longitudinal centre axis (A1, A2, A3) is spaced from the camshaft axis of rotation (D) in a plane (E) receiving the camshaft axis of rotation (D) and running perpendicularly to the tappet longitudinal centre axis (A1, A2, A3).

* * * * *